United States Patent [19]

Angulo

[11] 4,029,313

[45] June 14, 1977

[54] POOL TABLE CANOPIES

[76] Inventor: Herminio Angulo, 10563 Chaney Ave., Downey, Calif. 90241

[22] Filed: Dec. 9, 1975

[21] Appl. No.: 639,070

[52] U.S. Cl. ..... 273/2; 240/2 AD

[51] Int. Cl.[2] ..... A63D 15/00

[58] Field of Search ..... 273/2, 14; 240/2 AD, 240/108 R

[56] References Cited

UNITED STATES PATENTS 1,127,318 2/1915 Thomas ..... 273/2

FOREIGN PATENTS OR APPLICATIONS 7,344 3/1911 United Kingdom ..... 273/2

*Primary Examiner*—Anton O. Oechsle
*Assistant Examiner*—T. Brown
*Attorney, Agent, or Firm*—Kenneth T. Theodore

[57] ABSTRACT

A pool table lamp shade or canopy which holds and stores the accessories necessary to play the game of pool and additionally provides proper lighting distribution to the pool table. The accessories are conveniently stored above the pool table top and are readily accessible to all players. Accessories include the pool balls, cue sticks, ball rack and the score tally beads. The canopy is attached to a standard 48 inch, 2 lamp, fluorescent light fixture hung above the pool table, and envelopes said fixture to provide proper light distribution.

11 Claims, 7 Drawing Figures

FIG. 1

POOL TABLE CANOPIES

BACKGROUND OF THE INVENTION

There are several devices available today which hold and store pool balls, cue sticks and ball racks. These devices are either small, poorly constructed and unstable table models or wall mounted fixtures. The tables, although functional, are generally made to be placed against a wall, the exact location more dependent upon the room decor and not the table's utility. Additionally, the tables are not structurally sound and are more of a nuisance in the maintenance of an attractive family game room. In particular, they typically are unstable when fully loaded with their complement of pool accessories. Additionally, they do not have provisions for score tally beads.

The wall mounted fixtures available today are more stable than the tables and some have a small scaled score tally beads which, due to their small size, are not functional and seldom used by players.

Notwithstanding the above deficiencies of each structure, common to all is their inaccessibility for all players at any given time. A player wishing to move a score tally bead, or store a pool ball rack may find the table or wall fixture on the opposite side of the pool table. Thus its very position severly limits its utility. The invention presented herein overcomes the limited utility by placing all the pool accessories and a full size score tally bead directly over the pool table.

Canopies are available in a wide assortment of sizes and shapes and either is a slip-over version which mounts over a pre-exisitng light fixture or which comes with a light fixture as an integral part of the canopy. The basic function of a canopy is to direct illumination upon the pool table playing surface. Proper illumination will direct light only upon the playing surface, leaving the area around the pool table in a relatively subdued indirect light.

An additional function of a canopy is aesthetic, to compliment the game room decor, such as modern, traditional, spanish, and so forth.

The invention presented herein does not claim the above canopy functions, but does incorporate them into the preferred version as a necessary and useful feature.

OBJECTS OF THE INVENTION

The first object of my invention is to provide a storage receptacle for pool acessories which are necessary in the playing of pool and which is convenient and readily accessible to all players during the course of play. This is to be accomplished by placing the storage receptacle directly above the pool table playing surface and thus not limited to a remote wall location.

Another object of my invention is to provide a structure centrally located above the pool table playing surface from which all players have ready access to whatever accessories are required in the course of play, such as pool balls, ball rack, cue sticks, cue chalk and score tally beads.

Another object of my invention is to provide score tally beads which are readily accessible to all players by locating said beads directly above the center of the pool table playing surface.

Another object of my invention is to provide proper direct illumination of the pool table playing surface and a subdued, indirect lighting of the surrounding area through opaque covered apertures located on the sides and ends of the canopy.

These and further objects will be evident from the following disclosure, taken together with the accompanying drawings which illustrate a preferred form of the invention.

DESCRIPTION OF THE PREFERRED EMBODIMENT

Figure 1:
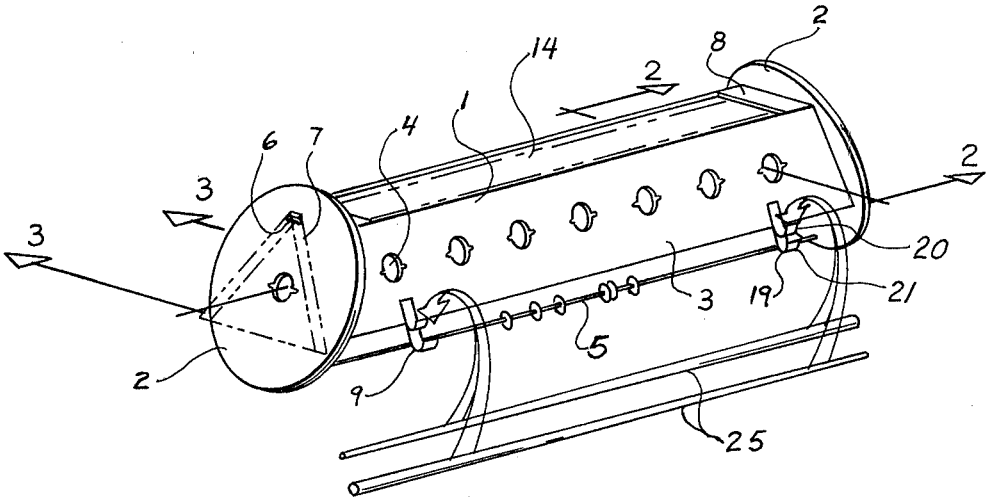
FIG. 1 is a top perspective view looking downward at the canopy structure.
Figure 2:
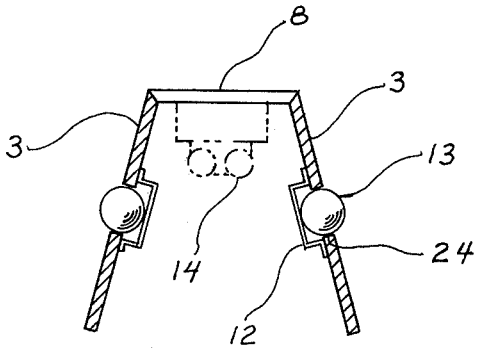
FIG. 2 is a sectional view taken along line 2—2 of FIG. 1, which illustrates the opaque shield, support base and the light fixture.

FIG. 1 schematically illustrates the obelisk shaped canopy structure 1 mounted upon and enveloping a standard 48 inch, 2 lamp, fluorescent light fixture 14, shown in phantom. The canopy lays upon the fixture 14 by support braces 8, placed internal to the canopy 1 at both ends 2 and flush with and traversing upper extremeties of the sides 3. The weight of the canopy 1 upon the fixture 14 prevents traverse movement between the braces 8 and the fixture 14. Positive attachment can be accomplished by securely attaching said braces 8 to the fixture 14 using commercially available steel bolts or screws. A more descriptive view of the canopy 1 laying upon the fixture 14 is shown in the sectional view of FIG. 2.

Said braces 8 are made of a hardwood material and attached to the sides 3 with commercially available adhesives.

The canopy ends 2 are circular in shape having a diameter of approximately 18 inches, said ends 2 are made from a hardwood material and are attached to the sides 3 by methods commonly used in the woodworking industry, such as butt joint, wood dowel pins, rabbitt joints plus appropriate wood adhesives.

Figure 3:
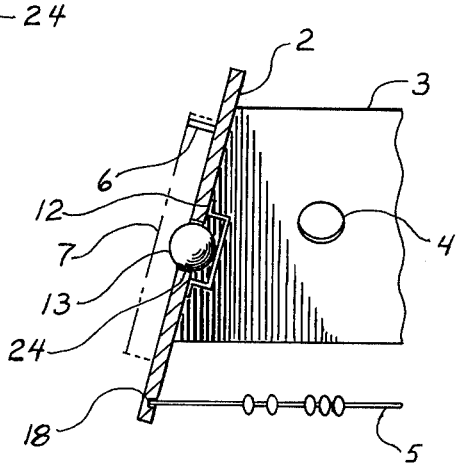
FIG. 3 is a sectional view taken along line 3—3 of FIG. 1, which illustrates the rack pin and a pool ball installed with an aperture.

A circular aperture 4 is machined perpendicular to the planar surface of, of the center of, and through the thickness of the ends 2. Said aperture 4 has a diameter slightly larger than the diameter of the pool ball 13. When the ball 13 is not in use and in a storage position, it is placed within the aperture 4. The aperture wall 24, being at an angle downwardly sloping toward the center of the canopy 1, will force the ball 13 by gravity action to traversely roll through the aperture 4 toward the canopy center. Said ball 13 is prevented from its traversing more than ⅛ inch into said aperture 4 by an opaque shield 12 mounted directly behind the aperture 4. This principle is readily apparent by referring to FIG. 3.

The opaque shield 12 is a C-channel shaped member made from an opaque plastic material. Said shield 12 has a controlled depth to maintain the above ⅛ inch dimension and has flanges by which it is attached to the ends 2. Means of attachment can be by commercially available adhesives or appropriate wood screws. Another function of said shield 12 is described below.

The slope of the aperture wall 24 is accomplished by inclining inwardly the upper portion of the ends 2 toward the canopy center at approximately 15° to 20° from the vertical plane. This inclination not only serves to place the ball 13 in a stable storage position but also provides proper direct lightning of the pool table playing surface only.

A triangular shaped ball rack 7, shown in phantom in FIG. 1 is used to align the pool ball in a triangular form prior to the start of play. This rack 7 is hung, when not in use, upon a cylindrical rack pin 6 fastened to the outside surface of one of the ends 2. The pin 6 is fixed perpendicular to the planar surface of the end 2 and located such that the rack 7 is centrally located upon the end 2 and about the aperture 4. As typical in the game of pool, the 'racking' of the pool balls typically takes place at only one end of the pool table, the 'rack side'. The end of the canopy 1 which has the pin 6 attached is to be placed at the 'rack side', thereby permitting ease of storage and quick accessibility of rack 7 when required.

The sides 3 are made from a hardwood material and are attached to the ends 2 as previously described. The sides 3 are trapezoidal shaped, having an overall length of approximately 56 inches and vertical height of 12 inches. The upper portion of said sides 3 are inwardly inclined toward the canopy center at approximately 15° to 20° from the vertical plane. Seven circular apertures 4 are machined perpendicular to the planar surface and through the thickness of side 3. The aperture center lines are equally spaced on the horizontal axis equally distant from the top and bottoms edges. The method of manufacturing and the purpose of the side apertures 4 are the same as the apertures 4 located on the ends 2.

An opaque translucent plastic shield 12 is attached behind each aperture 4 on the inward side of the side 3. The manner of attachment to the side 3 and the purpose of the shield 12 is the same as described above. One shield 12 will traverse behind all seven apertures 4. Besides being an economical means, this single piece shield 12 insures that the pool balls 13, in a stored condition, will all protrude from the apertures 4 an equal distance, thereby lending symmetry to the canopy 1.

Additionally, the shield 12 serves an additional important function. During the course of play, pool players prefer that the playing area surrounding the pool table be in a subdued, indirect lightning. Being opaque, the shield 12 prevents a direct lighting from traversing through the aperture 4 but diffuses said light permitting only enough through to dimly light said area.

Pool players find it advantageous to keep a current total of their indivudal scores by the use of score tally beads. The accessibility of the beads at the moment a player desires to change his score is, therefore, important to the proper use thereof. The invention provides this accessibility by attaching a score tally bead holder 5 to the canopy 1 underside, thus directly above the pool table playing surface. FIG. 1 depicts this holder 5 in detail. The holder 5 is a ¼ inch diameter steel tube, the end of which are slip fitted into complementary counterbored recesses 18 within the lower inside surface of each end 2, approximately one inch above the canopy lower horizontal extremeties. The recesses 18 are drilled to a depth of ⅝ inch and at an angle to the end 2 surface such that the holder axis is horizontal and parallel to the canopy 1. The holder length is predetermined by the angle of the ends and the depth of the recess 18.

The actual tally beads are commercially available in wood or plastic material. Upon purchase thereof, the beads will be drilled to a 5/16 inch diameter, which permits the beads to be easily installed over the holder 5. An end of the holder 5 is then inserted into one recess 18 of an assembled canopy 1. The holder 5, with beads installed, is then bowed slightly until its column length is shortened enought to be inserted into the complementary recess 18. The holder 5 then returns to the original straightened length with no permanent axial deformation.

Figure 4:
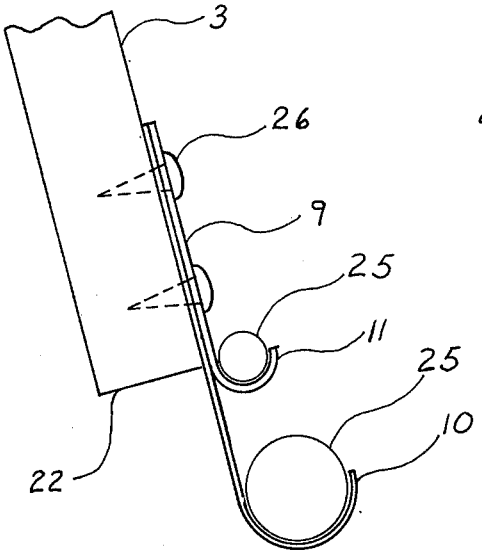
FIG. 4 is a side view of a left hand cue stick holder assembly.

The cue stick holder left hand assembly 9, depicted in FIG. 1 and detailed in FIG. 4 securely holds the cue sticks 25 in a horizontal position, parallel to the plane formed by each side 3 when used in conjunction with a complementary right hand assembly 19. The number of cue sticks which can be held varies in even multiples of 2, but for this preferred embodiment, holder assemblies for a total of four cue sticks 25 are described.

Each assembly 9, 19 consists of two preformed wrought iron straps, ¾ inch in width, 3/32 inch thick and of a predetermined length. The tip strap 11, 21 has a hook shaped profile, having one end rolled 180° to a ⅜ inch radius, large enough to hold the smaller diameter tip end of a cue stick 25 but too small for the cue stick handle to be inserted therein. The handle strap 10, 20 has a hook shaped profile, having one end rolled 180° to a ¾ inch radius, large enough to hold the handle end of a cue stick 25.

The left hand assembly 9 consists of a tip strap 11 attached to the top of a handle strap 10 by standard spot welding methods. The center lines of the two roll radius are held apart 1-⅞ inch. The overall length is 6 inches. The assembly 9 is attached to the outside face of the side 3, approximately 18 inches left of the side 3 vertical center line. The tip strap roll center line lies within the plane formed by the bottom face 22 of side 3. Attachment of the assembly 9 to the side 3 is by either ⅛ inch diameter 'pop' rivets or pan head wood screws 26.

The right hand assembly 19 consists of a handle strap 20 attached to the top of a tip strap 21 in a like manner as the assembly 9. The center lines of the two roll radius are held apart 1-⅞ inch, giving the assembly 19 an overall length of 5-⅝ inches. The assembly 19 is attached to the side 3 in a like manner except 18 inches to the right of the side 3 vertical center line and the handle strap roll radius center line lies within the plane formed by the bottom face 22.

The process of attaching assemblies 9, 19 to the opposite sides 3 is identical to that described above.

With the assemblies 9, 19 attached to the canopy 1, two cue sticks 25 can be placed within the respective assemblies 9, 19 for storage when not in use. As the large diameter handle end of a cue stick 25 cannot be inserted within a tip strap 11, 21 the cue sticks cannot be incorrectly stored. The axis of the sticks will be horizontal and parallel to each other with their truncated conical shape pointing in opposite directions.

In the stored condition, the cue sticks 25 are readily available to any player the moment they are required for play. Additionally, the parallel axes and opposite facing direction of the cue sticks 25 presents a balanced and aesthetically pleasing configuration.

Figure 6:
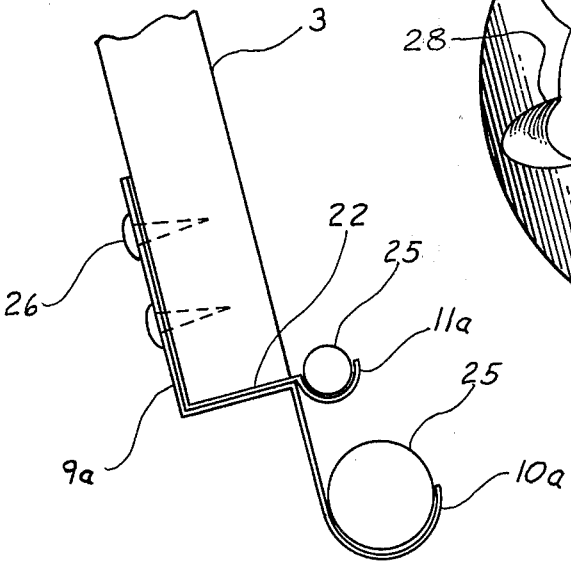
FIG. 6 is a side view of an alternate form of a left hand cue stick holder assembly.

The holder assemblies 9, 19 described are attractive in a spanish style but would not be suitable for a modern style. Therefore, an alternate means would be to mount or attach the altered assemblies 9*a*, 19*a* on the inside face of the sides 3. The straps 10*a*, 11*a*, 20*a*, 21*a* would be bent outwardly 90° along the edge 22 and again bent 90° downwardly at a distance from the first bend 90° such that the centers of said roll radius are at the positions described above. In this manner the function of the holder assemblies 9*a*, 19*a* is preserved but the strap ends are not exposed. This configuration is illustrated in FIG. 6.

Figure 5:
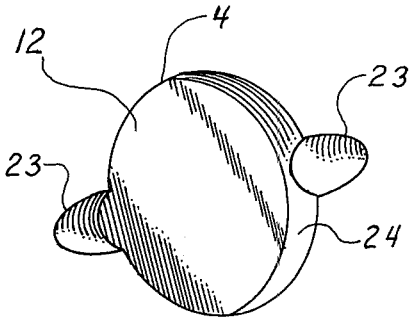
FIG. 5 is a downwardly looking perspective view of an aperture showing in detail the finger recesses.

Located on the cirumference of each aperture 4 are two finger recesses 23, as shown in FIG. 5. The recesses 23 are parabolic shaped with approximate dimensions of one inch length and ¾ inch width, and are located on the horizontal center line of said aperture 4, 180° apart from each other. The recesses 23 are made by a one inch diameter end mill cutter angled approximately 30° to the surface to be cut. The machining starts one inch beyond the aperture circumference and angularly proceed to a maximum cut depth of ½ inch. The recess 23 permits a player to easily remove a ball 13 by providing clearance for his fingers to protrude past the outside surface and into the aperture wall 24, thereby permitting gripping the ball 13 on its maximum diameter.

There are many possible methods and combinations in which the balls 13 can be stored and the lightning diffused, but the following preferred embodiment accomplishes both features into one component. Additionally, this is accomplished with a decrease in manufacturing costs and an increase in the appearance of said canopy.

Figure 7:
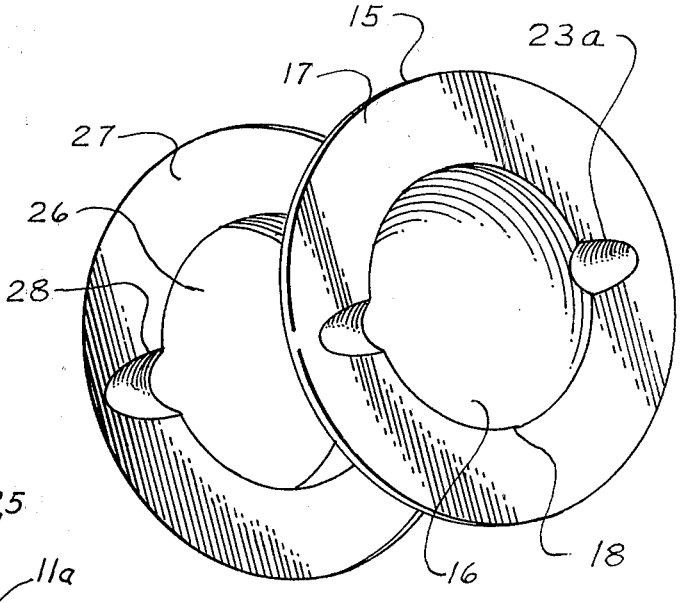
FIG. 7 is a donwardly looking perspective view of a ball cup used in lieu of an aperture and shield.

As illustrated in FIG. 7, a ball cup 15 replaces said apertures 4 and shield 12, said cup 15 used to store and hold an individual ball 13. Each cup 15 is located on said canopy 1 at the same location described for each aperture 4. The cup 15 is shaped as a half sphere with a spherical recess 16 therein, said recess 16 having a flat washer shaped flange 17 radially extending outward about the circumference. The said recess 16 has an inside radius slightly larger than that of a pool ball 13.

In lieu of the said apertures 4, a clearance hole 26 is machined through the canopy structure, said hole 26 being large enough for the cup 15 to be centrally fitted therein. The cup 15 rests upon the structure via the underside of said flange 17, and is secured thereto using commercially available adhesives.

An alternate method of installation would be to counter sink the surface of the ends 2 and sides 3 to a depth the diameter corresponding to the flange 17 thickness and diameter. In this manner, the outer flange surface would be flush with the canopy structure.

In the installed position, the cup 15 securely retains the pool ball 13 in the same manner as the aperture 4/shield 12 combination.

The cup 15 is manufactured from opaque plastic material using standard commercially availale injections molding machines and techniques. Two formed finger recesses 23*a* are molded on the flange 17 and within each cup 15. Said recesses 23*a* are identical in form and function to finger recesses 23. As obvious, the canopy structure must be machined to provide clearance 28 for said recesses 23*a*, thus permitting the flange underside to lay flat upon the structure. The cup opaque material provides the same light diffusion function as the shield 12. Additionally, the cup material may be color matched to that of the individual balls 13, eliminating the need to color coat the canopy 1 as mentioned previously.

Although the preferred embodiment described above specifies circular ends 2, this is necessitated only by a modern style decor. Oval, triangular, square or tapeezoidal shapes are possible and contemplated for production. Additionally, the canopy 1 can and is expected to be made in styles other than modern, such as traditional, spanish, colonial and others.

Additionally, all exposed surfaces shall be protected with commercially available paint or stain to match the particular style. Each aperture 4 will be color coated to match the color of the ball 13 stored therein. The solid colored balls 13, numbered 1 through 7 will be placed on one side 3, the striped balls 13, numbered 9 through 15 will be placed on the opposite side 3. The eight ball will be designated for the end 2 having the rack pin 6 and the cue ball will be stored in the opposite end 2.

Minor changes might be made with respect to some of the mechanical details illustrated and described in this specification. Therefore, only the following claims are intended to define the scope of the invention described herein.

Having thus described may invention, I claim:

1. A pool table canopy for the storage and readily accessibility of pool balls, comprising:

a pair of complementary but opposite facing end members inclined inwardly 15° to 20° from the vertical;

a pair of complementary but opposite facing side members, inclined inwardly 15° to 20° from the vertical, and attached to said end members forming an obelisk shaped structure;

a pair of complementary support braces attached to the inward face of said end members and said side members, traversing between the upper portion of said side members, and providing structural members for said canopy to support light fixtures thereon, each said end member and said side member having at least one aperture complementarily placed thereon, said aperture being used to hold and store a pool ball within said canopy and centrally above a pool table, the diameter of said aperture being slightly larger than the diameter of a conventional pool ball, said aperture being inwardly inclined to force the pool ball to traversely roll toward a central position of said canopy a substantially C-channel shaped, opaque translucent shield mounted behind said aperture on the said side members and end members, said shield preventing a stored ball from rolling through said aperture, said shield preventing direct lighting of the area surrounding the pool table by diffusing said light and permitting only indirect and subdued lighting of said area.

2. The structure set out in claim 1 wherein said aperture has two complementary, parabolic shaped recesses, located substantially 180° apart from each other on the aperture horizontal center line, said recesses providing access for a player's fingers to securely grip said stored ball on its major diameter, for removal from said aperture.

3. The structure set out in claim 1 wherein a cylindrical shaped rack pin is attached to at least one of said end members at the upper portion thereof and perpendicular to the outside planer surface thereof such that the triangular shaped ball rack can be stored upon said pin and centrally located upon said end member.

4. The structure set out in claim 1 wherein a score tally bead holder traverses the underside of said canopy between the lower inside surfaces of said end members.

said holder being made of a steel rod, the ends of which are fitted into predrilled recesses located on the lower, inside surfaces of said end members, upon which are fitted predrilled commercially available scoring beads, said holder being centrally located above a pool table and within easy accessibility of all players.

5. The structure set out in claim 1 wherein at least one pair of spaced apart cue stick holders are mounted on the lower extremity of the surface of at least one of said side members, each said holders being an hook shaped element one end of one being shaped to a radius slightly larger than a conventional thickness of the cue stick tip, and one end of the other element being shaped to a radius slightly larger than the thickness of a conventional cue stick handle, said holders being adapted to hold a cue sticks in a substantially horizontal position on a said side member to render it substantially centrally located above a pool table and within easy accessibility of all players.

6. The structure set out in claim 1 wherein:

said aperture has two said recesses located substantially 180° apart from each other on the said aperture horizontal center line;

a rack pin being attached to the upper portion of and perpendicular to the outside planer surface of at least one said end members;

a tally bead holder traverses the underside of said canopy between and attached to the lower inside planer surfaces of said opposite facing end members, upon which are placed counting beads;

a cue stick holder attached to the lower extremity of each of said side members and being adapted to support at least one cue sticks thereon.

7. A canopy for use with a pool table comprising:

a pair of spaced apart ends and a pair of spaced apart sides having one of said ends attached to each end thereof and support means for suspending said canopy above a pool table;

at least one substantially hemi spherical shaped ball receiving cup placed on at least one of said ends and at least one of said sides, the concaved side of said cup facing outwardly of said canopy, said cups being used to hold and store pool balls on said canopy, each of said cups being attached to said canopy within holes placed therein, the diameter of said holes being substantially equal to the diameter of said cups, each of said cups having a washer shaped flange radially extending outward about the lip of said cup and said flanges having formed therein finger receiving recesses to thereby facilitate removal of said cups from said holes, said cup being made from translucient opaque plastic material which prevents direct lighting of the area surrounding the pool table by diffusing said light and permitting only indirect and subdued lighting of said area.

8. The structure set out in claim 7 wherein a rack pin is attached to one of said end.

9. The structure set out in claim 7 wherein a score tally bead holder traverses the underside of said canopy between said ends.

10. The structure set out in claim 7 wherein a cut stick holder assembly is mounted in complimentary pairs on the lower extremity of the outside surfaces of each of said side.

11. The structure set out in claim 7 wherein:

a rack pin is attached to the upper portion of and perpendicular to the outside planar surface of at least one said end;

a tally bead holder traverses the underside of said canopy between and attached to the lower inside planer surfaces of said ends, upon which are placed counting beads;

said cue stick holder assemblies are attached in complementary pairs to the lower extremeties of said sides, said assemblies holding the cue sticks in horizontal and parallel axis.

* * * * *